US005481775A

United States Patent [19]

Gentile et al.

[11] Patent Number: 5,481,775

[45] Date of Patent: Jan. 9, 1996

[54] TOOTHBRUSH WITH MOVABLE HEAD

[75] Inventors: James L. Gentile, Orange, Conn.; Joseph E. Meenan, Pleasantville, N.Y.

[73] Assignee: Chesebrough-Pond's USA Co., Division of Conopco, Inc., Greenwich, Conn.

[21] Appl. No.: 453,727

[22] Filed: May 30, 1995

Related U.S. Application Data

[63] Continuation of Ser. No. 217,528, Mar. 22, 1994, abandoned.

[51] Int. Cl.[6] ..... A46B 9/04; A46B 7/06

[52] U.S. Cl. ..... 15/22.1; 15/167.1; 15/201

[58] Field of Search ..... 15/22.1, 167.1, 15/172, 176.1, 176.4, 176.5, 176.6, 201, 202

[56] References Cited

U.S. PATENT DOCUMENTS

| | | | |
|---|---|---|---|
| 993,617 | 5/1911 | Pokorney | 15/176.5 |
| 1,212,001 | 1/1917 | Baxter | 15/167.1 |
| 2,625,697 | 1/1953 | Cyser | 15/176.6 |
| 3,261,047 | 7/1966 | Klang | 15/22.1 |
| 3,806,980 | 4/1974 | Belsito | 15/22.1 |
| 4,333,199 | 6/1982 | Del Rosario | 15/201 |
| 4,575,894 | 3/1986 | Stevens | 15/176.5 |
| 4,783,869 | 11/1988 | Lee | 15/22.1 |
| 5,186,627 | 2/1993 | Amit | 15/22.1 |
| 5,269,038 | 12/1993 | Bradley | 15/201 |

FOREIGN PATENT DOCUMENTS

| | | | |
|---|---|---|---|
| 245726 | 3/1966 | Austria | 15/22.1 |
| 1321920 | 2/1963 | France | 15/22.1 |
| 2578408 | 9/1986 | France | 15/22.1 |
| 2615709 | 12/1988 | France | 15/167.1 |
| 2616306 | 12/1988 | France | 15/167.1 |
| 294298 | 1/1954 | Switzerland | 15/22.1 |
| WO92/17094 | 10/1992 | WIPO . | |

*Primary Examiner*—Stephen F. Gerrity
*Assistant Examiner*—Randall E. Chin
*Attorney, Agent, or Firm*—Gerard J. McGowan, Jr.

[57] ABSTRACT

A toothbrush having a head which moves in an arc about the longitudinal axis of the brush in a spiral track. The brush comprises bristles, a bristle base from which the bristles extend, a panel in which the bristle base slides, a head base and a handle. The panel is attached to the head base by a hinge. The panel is curved and includes an elongated aperture which forms the track for the bristle base.

8 Claims, 3 Drawing Sheets

TOOTHBRUSH WITH MOVABLE HEAD

This is a continuation application of Ser. No. 08/217,528 filed Mar. 22, 1994, now abandoned.

BACKGROUND OF THE INVENTION

Designers of toothbrushes have sought to optimize the brushes so that they are better able to reach all of the teeth in the mouth. In this respect, much attention has focused on the angle of the toothbrush head to the handle.

Another issue concerning toothbrush use, although usually more associated with the manner of use rather than the toothbrush structure, is the direction in which brushing should be carried out. It has been suggested by some that brushing should be conducted in an up-and-down direction rather than from side to side. A possible advantage of the up-and-down motion is that this may decrease the likelihood that receding gums will expose sensitive areas at the base of the teeth. However, side-to-side brushing has the advantage that difficult-to-access areas toward the rear of the mouth are more likely to be subjected to the brushing action.

Del Rosario U.S. Pat. No. 4,333,199 discloses a toothbrush which is mounted using a coil spring interconnecting the brush base and handle. This is said to provide for a swinging, rotatable, tilting movement of the brush relative to the handle during use.

Bradley PCT International Publication No. WO 92/17094, based on the priority of U.S. application Ser. Nos. 677,656 and 745,892, is directed to a toothbrush which is said automatically to provide an up-down action in concert with a side-to-side stroking action. Numerous embodiments are disclosed. In the embodiment of FIGS. 1–5, for instance, the brush pad is pivotally attached with a hinge which comprises a rod-like member which is received within a receptor comprising an elongate groove. As the brush is stroked, the brush pads will rock outwardly or inwardly. In the embodiments of FIGS. 17 and 18, the pads slide within an elongate slide member disposed at an angle with respect to the longitudinal axis of the pad.

SUMMARY OF THE INVENTION

The present invention is directed to a toothbrush wherein the bristles move in both an up-and-down and in-and-out direction as the toothbrush is moved side to side along the teeth in the mouth. The up-and-down movement of the bristles is reflected in movement at an angle from 20° to 160° to the longitudinal axis of the head, as measured in the horizontal plane extending through the head and generally perpendicular to the bristles. The in-and-out motion of the bristles occurs as a result of travel of the bristles and bristle base along an arc about the longitudinal axis of the head.

Preferably, the base for the bristles follows a spiral track to produce the desired motion. The spiral track may be provided by an elongated aperture in a curved panel associated with the head of the toothbrush. The bristles and the base into which they are inserted may be detachable from the rest of the toothbrush head and so may be furnished in the form of a refill.

For a more complete understanding of the above and other features and advantages of the invention, reference should be made to the following detailed description of preferred embodiments and to the accompanying drawings.

DETAILED DESCRIPTION OF THE INVENTION

Figure 1:
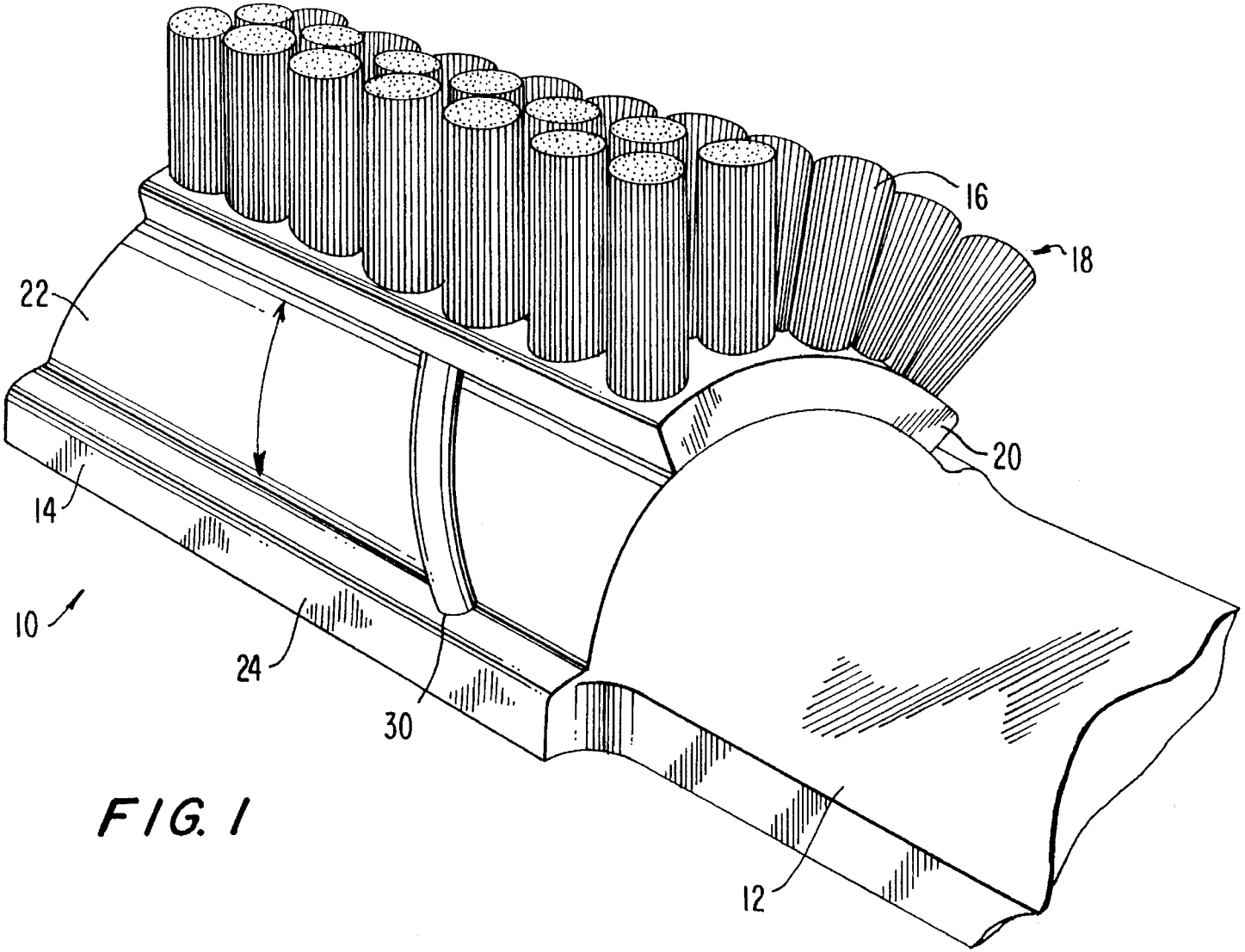
FIG. 1 is a perspective view of a toothbrush according to the invention, with portions of the handle broken away.

Toothbrush 10 comprises a handle 12 and a head 14. Head 14 includes bristles 16 bundled into tufts 18 which extend in an upright fashion from bristle base 20. Bristle base 20 is in the form of a platform taking the shape of a curve or an arc with respect to the longitudinal axis of the toothbrush head.

Bristle base 20 rests upon tracking panel 22. Tracking panel 22 is associated with one side of base 24 of head 14 by means of hinge 26 (See FIG. 4). Like bristle base 20, panel 22 forms an arc with respect to the longitudinal axis of the head; the arc of the panel is preferably substantially the same as that of the bristle base so that the bottom surface of the bristle base can rest contiguously upon the top surface of the panel. The arc shaped bottom surface of the bristle base is supported on the arc shaped surface of the head so that the arc shaped bottom surface of the bristle base can slide on the arc shaped supporting surface of the head. The arc shaped supporting surface may comprise a panel . Moreover, the top surface of the panel is wider than the top surface of the bristle base and the curves of the; bristle base and the panel match so that the bristle base bottom is contiguous with the top of the panel 22 regardless of where the bristle base is disposed laterally with respect to the panel.

Panel 22 comprises one or more elongated apertures 30. Preferably, apertures 30 extend from a point spaced inwardly of one side edge of the panel to a second side edge of the panel, at which the aperture is open. Apertures 30 are adapted to receive sliding member 36 which extends from the bottom of bristle base 20, as will be described in more detail below.

Apertures 30 extend at a horizontal angle (angle measured in the horizontal plane extending through the head of the toothbrush) to the longitudinal axis of the toothbrush of from 20° to 160°, preferably from 30° to 150° and especially from 80° to 150°. Since the bristles and bristle head will travel in the direction of the elongated opening, the angle of the aperture reflects the direction the bristles will take, generally transverse to the direction in which the toothbrush is moved. A generally rectangular recess 38 is formed in the head base 24 to accommodate slide member 36 when the toothbrush is assembled.

Figure 6:
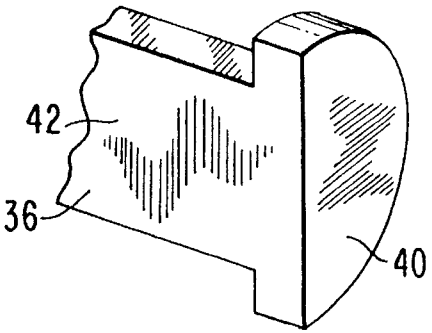
FIG. 6 is an enlarged view of the sliding means shown in FIG. 5.
Figure 5:
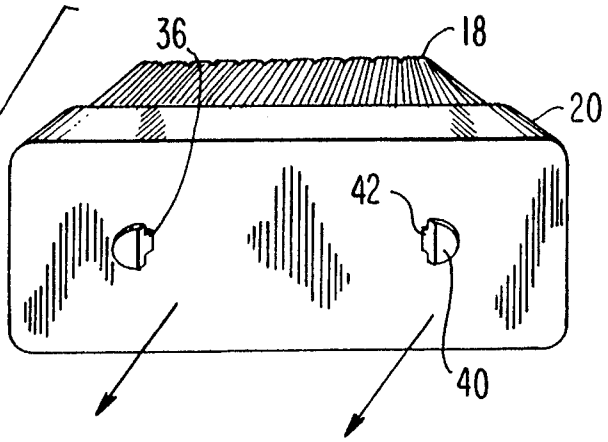
FIG. 5 is a bottom plan view of a bristle base according to the invention, in assembly with a side elevation view of a tracking panel on the toothbrush head.
Figure 5:
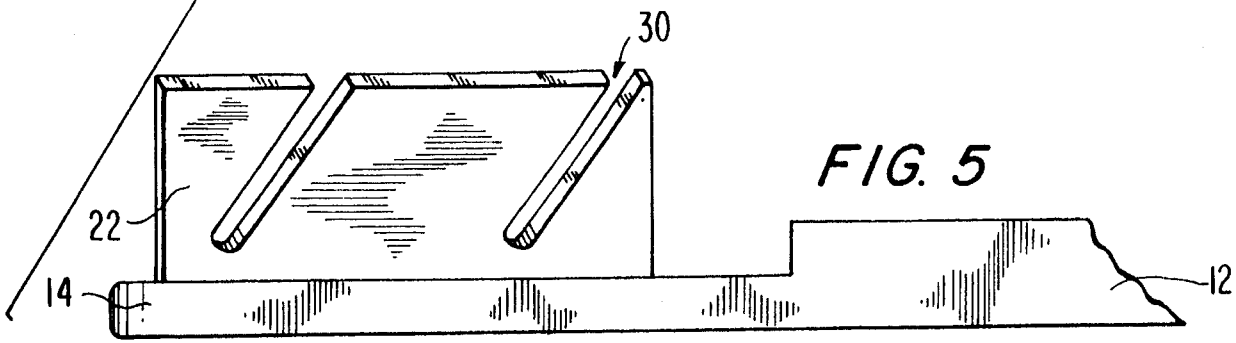

One or more sliding members 36 extend from the bottom of bristle base 20 and is a protuberance comprising a head or retaining flange 40 and a stem 42. The elongated stem 42 is narrow enough to slide within elongated aperture 30. Retaining flange 40, however, is wider than the width of aperture 30 so that member 36 is retained within aperture 30 when both ends of panel 22 are secured, as when the panel is closed. Preferably retaining flange head 40 has the shape of a half moon, as best seen in FIG. 6.

Figure 4:
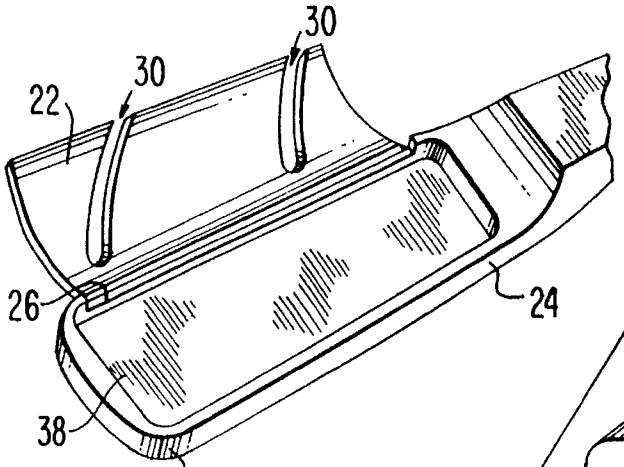
FIG. 4 is a perspective view of a toothbrush head according to the invention having the bristles and bristle base removed and the tracking panel opened up.

The toothbrush is assembled in the following manner, beginning with the brush base having an open panel as shown in FIG. 4. The sliding member 36 of the bristle base is placed at the edge of the panel 22 where the elongated aperture opens into the free edge of the panel. Stem 42 of the member is placed within the aperture 30 and retaining flange 40 is disposed on the opposite side of the panel from the rest of the bottom of bristle base 20. Panel 22 is then secured to head base 24 either by mechanical means or by an adhesive.

Figures 2, 3:
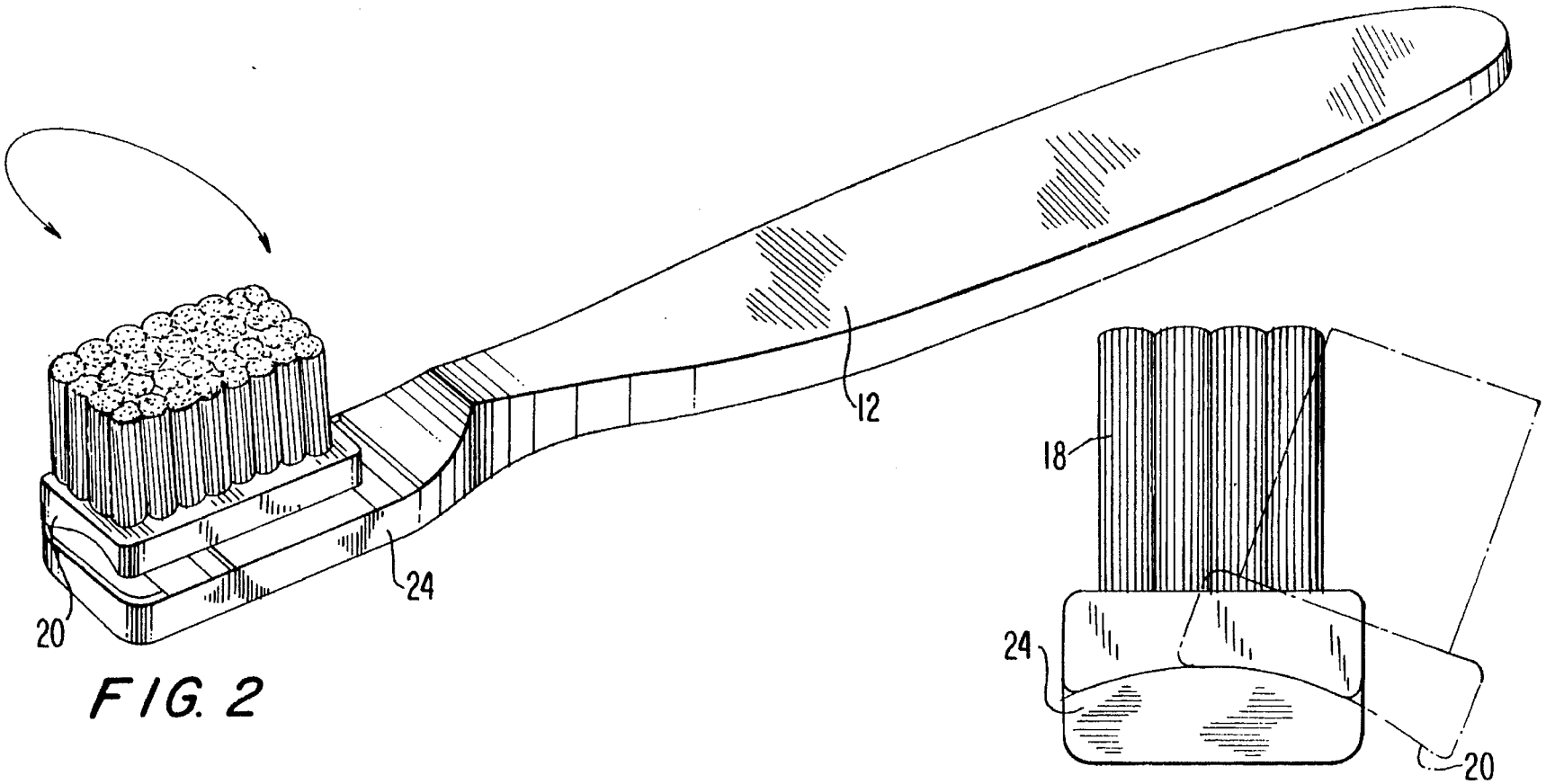
FIG. 2 is another perspective view of the toothbrush.
FIG. 3 is a front elevational view of the toothbrush showing the bristles and bristle head in an alternate position in phantom.

In use, if the brush is applied to teeth from side to side, the bristles and bristle base 20 will follow the curvature of both elongated aperture 30 and of the arc of panel 22. This results in a spiral motion. The horizontal angle of the aperture with respect to the longitudinal axis of the toothbrush head imparts to the bristle base and bristles a motion somewhat transverse to the direction along which the toothbrush is applied to the teeth. Arrows showing the direction of this motion can be seen in FIGS. 1 and 2. At the same time, the curvature or arc of the bristle base and of the panel 22 imparts to the bristle base and bristles a motion into and out of the plane of the teeth. In FIG. 3, an extreme position for the bristle base and bristles is shown for one side of the toothbrush. It will be appreciated that the bristle base and bristles will be able to assume a similar extreme position on the other side of the toothbrush and all positions in between, including the center position shown in solid lines.

The toothbrush handle, the head base, the panel, the bristle base and the bristles may all be made of materials well known in the art, such as thermoplastic materials.

It should be understood, of course, that the specific forms of the invention herein illustrated and described are intended to be representative only, as certain changes may be made therein without departing from the clear teaching of the disclosure. Accordingly, reference should be made to the following appended claims in determining the full scope of the invention.

What is claimed is:

1. A toothbrush comprising a first end and a second end, said first end including a handle and said second end having, a head, a bristle base supported on said head, said head having a longitudinal axis and said bristle base having bristles extending upright from said bristle base, said bristle base having an arc-shaped bottom shaped as an arc about the longitudinal axis, said head including a panel supporting said bristle base, said panel being curved in the shape of an arc about the longitudinal axis and including an elongated aperture forming a spiral track for the bristle base said bristle base having means engaging said spiral tracks, said bristle base being movable relative to said head by sliding of said bristle base arc shaped bottom over the arc-shaped supporting panel.

2. The toothbrush according to claim 1 wherein said panel is attached to said head by a hinge.

3. The toothbrush according to claim 1 wherein said bristle base engaging means comprises a protuberance dimensioned to be received within the elongated aperture of said panel.

4. The toothbrush according to claim 3 wherein said protuberance includes a retaining flange for retaining said protuberance within said panel.

5. A toothbrush comprising a first end and a second end, said first end including a handle and said second end having a head, said head having an arc-shaped supporting surface, a bristle base having an arc-shaped bottom supported on said arc-shaped supporting surface of said head, said head having a longitudinal axis and said bristle base having bristles extending upright from said bristle base, said arc-shaped supporting surface of said head including a plurality of elongated apertures forming a plurality of spiral tracks for the bristle base, said bristle base having means engaging said spiral tracks, said bristle base being moveable relative to said head by sliding of said bristle base arc shaped bottom oh said arc shaped supporting surface.

6. The toothbrush according to claim 5 wherein said arc-shaped supporting surface is attached to said head by a hinge.

7. The toothbrush according to claim 5 wherein said bristle base engaging means comprises a protuberance dimensioned to be received within the elongated apertures of said arc shaped supporting surface of said head.

8. The toothbrush according to claim 7 wherein said protuberance includes a retaining flange for retaining said protuberance within said arc shaped supporting surface of said head.

* * * * *